US008431230B2

(12) United States Patent
Takahashi et al.

(10) Patent No.: US 8,431,230 B2
(45) Date of Patent: Apr. 30, 2013

(54) CAST PRODUCT HAVING ALUMINA BARRIER LAYER

(75) Inventors: Makoto Takahashi, Hirakata (JP); Youhei Enjo, Hirakata (JP); Shinichi Uramaru, Hirakata (JP)

(73) Assignee: Kubota Corporation, Osaka-shi (JP)

( * ) Notice: Subject to any disclaimer, the term of this patent is extended or adjusted under 35 U.S.C. 154(b) by 0 days.

(21) Appl. No.: 13/256,392

(22) PCT Filed: Mar. 23, 2010

(86) PCT No.: PCT/JP2010/055500

§ 371 (c)(1), (2), (4) Date: Sep. 13, 2011

(87) PCT Pub. No.: WO2010/113830

PCT Pub. Date: Oct. 7, 2010

(65) Prior Publication Data

US 2011/0318593 A1 Dec. 29, 2011

(30) Foreign Application Priority Data

Mar. 31, 2009 (JP) ..... 2009-084247

(51) Int. Cl.
*B32B 15/04* (2006.01)

(52) U.S. Cl.
USPC ..... 428/469; 428/472.2; 428/328; 428/329

(58) Field of Classification Search ..... None
See application file for complete search history.

(56) References Cited

U.S. PATENT DOCUMENTS

| | | | |
|---|---|---|---|
| 4,204,862 | A | 5/1980 | Kado et al. |
| 4,668,585 | A | 5/1987 | Tsuji et al. |

FOREIGN PATENT DOCUMENTS

| | | | |
|---|---|---|---|
| CN | 101381849 | * | 3/2009 |
| DE | 26 48 968 | A1 | 5/1977 |
| JP | 52-078612 | A | 7/1977 |
| JP | 57-039159 | A | 3/1982 |

(Continued)

OTHER PUBLICATIONS

Notification of Transmittal of Translation of the International Preliminary Report on Patentability (Form PCT/IB/338) of International Application No. PCT/JP2010/055500 mailed Nov. 24, 2011 with forms PCT/IB/373 and PCT/ISA/237.

(Continued)

*Primary Examiner* — Vera Katz
(74) *Attorney, Agent, or Firm* — Westerman, Hattori, Daniels & Adrian, LLP

(57) ABSTRACT

A cast product for use in high temperature atmosphere comprising a cast body of a heat-resistant alloy comprising of, in mass percent, 0.05 to 0.7% of C, over 0% to up to 2.5% of Si, over 0% to up to 3.0% of Mn, 15 to 50% of Cr, 18 to 70% of Ni, 2 to 4% of Al, 0.005 to 0.4% of rare-earth elements, and 0.5 to 10% of W and/or 0.1 to 5% of Mo, the balance being Fe and inevitable impurities, and a barrier layer formed at a surface of the cast body to be brought into contact with said high temperature atmosphere, said barrier layer comprising an $Al_2O_3$ layer having a thickness of 0.5 μm or more wherein at least 80 area % of the outermost surface thereof is $Al_2O_3$, and said cast product having Cr-based particles dispersed at an interface between the $Al_2O_3$ layer and the cast body at a higher Cr concentration than that of a matrix of the alloy.

15 Claims, 2 Drawing Sheets

FOREIGN PATENT DOCUMENTS

| | | | |
|---|---|---|---|
| JP | 60-092440 | A | 5/1985 |
| JP | 60-262945 | A | 12/1985 |
| JP | 1-279741 | A | 11/1989 |
| JP | 6-248393 | A | 9/1994 |
| JP | 7-278757 | A | 10/1995 |
| JP | 10-140296 | A | 5/1998 |
| JP | 2000-008152 | A | 1/2000 |
| JP | 2004-218015 | A | 8/2004 |

OTHER PUBLICATIONS

International Search Report of PCT/JP2010/05550, mailing date Jun. 29, 2010.

European Search Report dated Jul. 13, 2012, issued in corresponding European Patent Application No. 10758601.8, (5 pages).

* cited by examiner

CAST PRODUCT HAVING ALUMINA BARRIER LAYER

TECHNICAL FIELD

The present invention relates to heat-resistant castings such as reactor tubes for producing ethylene, and hearth rolls and radiant tubes for use in carburizing heat-treatment furnaces.

BACKGROUND ART

Austenitic heat-resistant alloy having excellent strength at high temperatures is favorably used for heat-resistant castings, such as reactor tubes for producing ethylene, which are exposed to high temperature atmosphere for a prolonged period of time.

During use in high temperature atmosphere, a metal oxide layer is formed over the surface of austenitic heat-resistant alloy, and the layer serves as a barrier for giving sustained heat resistance to the material, whereby the material can be protected from high ambient temperatures.

However, when the metal oxide is Cr-oxides (consisting mainly of $Cr_2O_3$), the oxide layer is low in density and deficient in tight adhesion and therefore has the problem of being prone to spall off during repeated cycles of heating and cooling. Even if remaining unseparated, the layer fails to sufficiently function to prevent penetration of oxygen and carbon from the outside atmosphere, exhibiting the drawback of permitting the internal oxidation or carburization of the material.

In this regard, the following patent literature has been proposed in connection with austenitic heat-resistant alloys which are adjusted in components and composition to ensure the formation of an oxide layer comprising mainly of alumina ($Al_2O_3$) having high density and resistant to the penetration of oxygen and carbon.

Patent Literature I: JP Unexamined Patent Publication SHO52-78612

Patent Literature 2: JP Unexamined Patent Publication SHO 57-39159

These disclosures of Patent Literature are adapted to form over the surface of the material an oxide layer consisting mainly of $Al_2O_3$ by giving a higher Al content than in common austenitic heat-resistant alloys.

Patent Literature 1 proposes an Al content of over 4% and Patent Literature 2 an Al content of at least 4.5% in order to form an $Al_2O_3$ layer of sufficient thickness which is prevented from spalling off during use at high temperatures.

Al is a ferrite forming element, and accordingly an increased Al content impairs the ductility of the material to result in decreased strength at high temperatures. This tendency toward decreased ductility is observed when the Al content increases over 4%.

Accordingly, the austenitic heat-resistant alloys of the foregoing literature have the drawbacks of exhibiting impaired ductility although improved barrier function in high temperature atmosphere is expectable as afforded by the $Al_2O_3$ layer.

DISCLOSURE OF THE INVENTION

Problem to be Solved by the Invention

In view of the foregoing problems, an object of the present invention is to provide a cast product of a heat-resistant alloy which can be provided with an $Al_2O_3$ layer having high-temperature stability even when the material is not over 4% in Al content, permitting the material to retain an improved barrier function in high temperature atmosphere without becoming impaired in ductility.

Means for Solving the Problem

The present invention provides a cast product for use in high temperature atmosphere, said cast product comprising a cast body of a heat-resistant alloy comprising of, in mass percent, 0.05 to 0.7% of C, over 0% to up to 2.5% of Si, over 0% to up to 3.0% of Mn, 15 to 50% of Cr, 18 to 70% of Ni, 2 to 4% of Al, 0.005 to 0.4% of rare-earth elements, and 0.5 to 10% of W and/or 0.1 to 5% of Mo, the balance being Fe and inevitable impurities, a barrier layer formed at a surface of the cast body to be brought into contact with the high temperature atmosphere, said barrier layer comprising an $Al_2O_3$ layer having a thickness of 0.5 μm or more wherein at least 80 area % of the outermost surface of thereof is $Al_2O_3$, and said cast product having Cr-based particles dispersed at an interface between the $Al_2O_3$ layer and the cast body at a higher Cr concentration than that of a matrix of the alloy.

The barrier layer is allowed that Cr-oxide scales consisting mainly of $Cr_2O_3$ are deposited and scattered around on the $Al_2O_3$ layer, up to less than 20 area % of the outermost surface of the barrier layer.

When desired, at least one of 0.01 to 0.6% of Ti, 0.01 to 0.6% of Zr, 0.1 to 1.8% of Nb and up to 0.1% of B can further be incorporated into the heat-resistant alloy.

The Cr-based particles contain Cr, Ni, Fe and W and/or Mo, the Cr content being over 50% in mass percent.

The foregoing $Al_2O_3$ layer can be formed preferably by machining the surface of the cast body to a surface roughness (Ra) of 0.05 to 2.5 and thereafter heat-treating the machined cast body in an oxidizing atmosphere of at least 1050° C. In the case where this heat treatment is conducted at a temperature of below 1050° C. (but not lower than 900° C.), the lower limit for the rare earth elements among the foregoing components of the heat-resistant alloy is set at 0.06%, with the upper limit for W set at 6%, whereby the foregoing $Al_2O_3$ layer can be obtained in the same manner as formed at a temperature of at least 1050° C.

Advantages of the Invention

The product of the present invention is cast from a heat-resistant alloy which is up to 4% in Al content, so that the product is reduced in the degradation of ductility and can be given high strength at high temperatures.

The present cast product comprises a barrier layer formed at a surface of the cast body to be brought into contact with said high temperature atmosphere, wherein said barrier layer comprises an $Al_2O_3$ layer having a thickness of at least 0.5 μm and at least 80 area % of the outermost surface thereof is $Al_2O_3$, thus effectively preventing oxygen, carbon, nitrogen, etc. from penetrating inside the cast body, during use in high temperature atmosphere.

The term "high temperature atmosphere" as used herein indicates atmosphere exposed to oxidation environments under the conditions of repeatedly heating and cooling, as well as atmosphere exposed to such environments like carburization, nitridation, sulfurization etc., at temperatures of around 800° C. or higher.

When a cast body made of the present Cr—Ni—Al-based heat-resistant alloy is formed at its surface with the $Al_2O_3$ layer, an undesirable Cr-oxide scale which is in the form of a small particle and consists mainly of $Cr_2O_3$ is likely to be deposited and scattered around on the $Al_2O_3$ layer. According to the present invention, when the surface of the cast product is examined using SEM (Scanning Electron Microscope)/EDX (Energy Dispersive X-ray Analyzer), it can be seen that said surface to be occupied by Cr-oxides is less than 20 area %, and at least 80 area % of said surface is $Al_2O_3$. Thus, even in the case where the Cr-oxide scales are deposited on the $Al_2O_3$ layer, the deposited Cr-oxide scale is small in size and amount, with the result that even if the Cr-oxide scale spalls off during use at high temperatures, it is almost unlikely that the underlying $Al_2O_3$ will be separated along with the chromium oxide.

Since dispersed at the interface between the $Al_2O_3$ layer and the cast body are Cr-based particles at a higher Cr concentration than in a matrix of the alloy matrix, the $Al_2O_3$ layer is resistant to spalling off during use at high temperatures. The $Al_2O_3$ layer is therefore very satisfactory in spalling resistance.

In this way, the presence of the stabilized $Al_2O_3$ layer gives the cast product of the present invention outstanding cyclic oxidation resistance, carburization resistance, nitriding resistance, corrosion resistance, etc. over a prolonged period of time of use in high temperature atmosphere.

BEST MODE OF CARRYING OUT THE INVENTION

Figure 1:
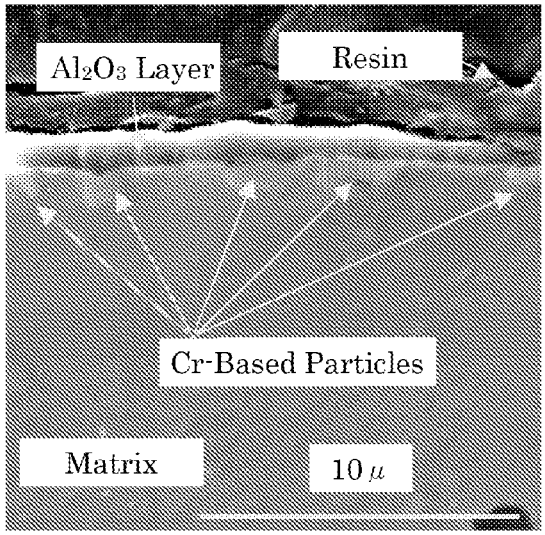
FIG. 1 is an SEM photograph of a section of Invention Example Sample No. 7 in the vicinity of the surface thereof.

A detailed description will be given below of the mode of carrying out the present invention.

Explanation of reasons for limiting the components of the heat-resistant alloy for providing the cast product of the present invention will be given below, in which the "%" indicated below is all mass percent unless otherwise specified.

<Reasons for Limiting the Components>

C: 0.05-0.7%

C acts to give good castability and enhanced high-temperature creep rupture strength. Accordingly, at least 0.05% of C should be present. However, an excessive C content is liable to extensively form the primary carbide of $Cr_7C_3$ to result in an insufficient supply of Al to the surface portion of the cast body and form a locally divided $Al_2O_3$ layer, impairing the continuity of the $Al_2O_3$ layer. Furthermore, an excess of secondary carbide will become precipitated to entail decreased ductility and lower toughness. Accordingly, the upper limit should be 0.7%. More preferably, the C content should be 0.3 to 0.5%.

Si: over 0% to up to 2.5%

Si is incorporated to serve as a deoxidizer and give higher fluidability to molten alloy. However, an excessive Si content leads to lower high-temperature creep rupture strength, so that the upper limit should be 2.5%. The Si content is more preferably up to 2.0%.

Mn: over 0% to up to 3.0%

Mn is incorporated to serve as a deoxidizer of molten alloy and fix S in melt, whereas an excessive Mn content entails impaired high-temperature creep rupture strength. The upper limit should therefore be 3.0%. More preferably, the Mn content is up to 1.6%.

Cr: 15-50%

Cr contributes to improvements in high-temperature strength and cyclic oxidation resistance. We have found that when Cr-based particles are formed as dispersed at the interface between the $Al_2O_3$ layer and the cast body, the $Al_2O_3$ layer becomes resistant to spalling off Accordingly, at least 15% of Cr should be present. However, an excessive Cr content results in lower high-temperature creep rupture strength, so that the upper limit should be 50%. The Cr content should more preferably be 23 to 35%.

Ni: 18-70%

Ni is an element necessary for cyclic oxidation resistance and a stable metal structure. If an insufficient amount of Ni is present, a relatively increased Fe content will result, so that a Cr—Fe—Mn oxide becomes easily formed in a surface of the cast body, consequently inhibiting the formation of the $Al_2O_3$ layer. Accordingly, at least 18% of Ni should be present. Since Ni content in excess of 70% will not produce an effect corresponding to the increase, the upper limit should be 70%. The Ni content is more preferably 28 to 45%.

Al: 2-4%

Al is an element effective for improvements in carburization resistance and anti-coking properties. Further according to the present invention, this element is essential for producing an $Al_2O_3$ layer over the surface of the cast body. For these reasons, at least 2% of Al should be present. However, since more than 4% of Al, if present, will lead to lower ductility as previously stated, the upper limit should be 4% accordingly to the invention. More preferably, the Al content is 2.5 to 3.8%.

Rare-Earth Elements: 0.005-0.4%

The term "rare-earth elements" means 17 elements including 15 elements of the lanthanide series ranging from La to Lu in the Periodic Table, and Y and Sc. The rare-earth elements to be incorporated into the heat-resistant alloy of the present invention are mainly Ce, La and Nd. As for the rare-earth elements to be incorporated into the present alloy, these three elements preferably occupy, in a combined amount, at least about 80%, more preferably at least about 90%, of the total amount of the rare-earth elements. These rare-earth elements contribute to promoted formation of the $Al_2O_3$ layer and to more effective stabilization thereof.

In the case where the $Al_2O_3$ layer is formed by heat treatment in an oxidizing atmosphere having a higher temperature of at least 1050° C., the alloy of the invention is made to have a rare-earth element content of at least 0.005%. This effectively contributes to the formation of $Al_2O_3$ layer. Since the precipitation of Cr carbides is accelerated at high temperatures, the layer is adhered with Cr-based particles provided at the interface between $Al_2O_3$ and the cast body, while rendering the layer resistant to spalling off, so that even a small amount of rare-earth elements function effectively.

Incidentally, when the $Al_2O_3$ layer is formed by heat treatment in an oxidizing atmosphere having a temperature of below 1050° C. (but preferably at least 900° C.), an insufficient effect to form the $Al_2O_3$ layer will result, if the rare-earth element content is lower than 0.06%, so that the content should be at least 0.06%.

On the other hand, an excessive amount of rare-earth elements impairs the ductility and toughness. The upper limit should therefore be 0.4%.

W: 0.5-10% and/or Mo: 0.1-5%

W and Mo form a solid solution in the matrix, fortifying the austenitic phase of the matrix and thereby affording improved creep rupture strength. To obtain this effect, the alloy should contain at least one of W and Mo. W should be present in an amount of at least 0.5%, and Mo in an amount of a least 0.1%.

However, if W and Mo are present in an excessive amount, lower ductility or impaired carburization resistance will result. Further as is the case with the presence of an excess of $(Cr, W, Mo)_7C_3$ will be formed to an increased extent, causing an insufficient supply of Al to the surface portion of the cast body, producing a locally divided $Al_2O_3$ layer and entailing the likelihood of impairing the continuity of the $Al_2O_3$ layer. W and Mo are great in atomic radius, so that when forming a solid solution in the matrix, these elements act to hamper the movement of Al or Cr and inhibit the formation of the $Al_2O_3$ layer.

Accordingly, the W content should be up to 10%, or the Mo content up to 5%. When both of these elements are present, it is desired that the combined content be up to 10%.

Al and Cr move more actively with a rise in temperature. In the case where the $Al_2O_3$ layer is formed at a higher temperature of at least 1050° C., therefore, W or Mo is less likely to exert influence on the formation of the $Al_2O_3$ layer, and no trouble occurs in the above-mentioned range, whereas if the layer is formed at a temperature lower than 1050° C., it is desirable to reduce the W or Mo content. Accordingly, in the case where the $Al_2O_3$ layer is formed at a temperature of lower than 1050° C., up to 6% of W or up to 5% of Mo should be present. When both the elements are present, it is desired that these elements be present in a combined amount of up to 6%.

At least one of Ti: 0.01-0.6%, Zr: 0.01-0.6% and Nb: 0.1-1.8%

Ti, Zr and Nb are elements which readily form carbides and function to give improved creep rupture strength. Since these elements do not form a solid solution in the matrix so easily as W or Mo, they do not likely to exhibit any particular action in forming the $Al_2O_3$ layer. Therefore, at least one of Ti, Zr and Nb can be incorporated into the alloy when required. The amount is at least 0.01% for Ti and Zr, and at least 0.1% for Nb.

However, an excessive addition of these elements entail reduced ductility. In addition, an excess use of Nb lowers the spalling resistance of the $Al_2O_3$ layer. So, the upper limit of these elements should be 0.6% for Ti and Zr, and 1.8% for Nb.

B: up to 0.1%

B, which acts to fortify the grain boundaries of the cast body, can be incorporated into the alloy as desired. Since an excess of B will entail impaired creep rupture strength, the amount of B should be up to 0.1% when to be used.

The heat-resistant alloy for providing cast products of the present invention contains the above alloy components, the balance being Fe, while P, S and other impurities which become inevitably incorporated into the alloy when the material is prepared by melting can be present insofar as such impurities are in amounts of ranges usually allowable for alloys of type mentioned.

<$Al_2O_3$ Layer>

The $Al_2O_3$ layer is highly dense and serves as a barrier for preventing oxygen, carbon and nitrogen from penetrating into the alloy from outside. According to the present invention, therefore, a cast body is machined or ground to a shape in conformity with the contemplated use of the cast product and is thereafter heat-treated in an oxidizing atmosphere, whereby a continuous $Al_2O_3$ layer as a barrier layer is formed in a surface of the part of the cast body to become brought into contact with high temperature atmosphere during use of the cast product.

The $Al_2O_3$ layer is at least 0.5 μm in thickness so as to effectively perform the barrier function. Although the upper limit of the thickness need not be defined specifically, the thickness need not be greater than about 10 μm from the viewpoint of reducing the running cost of forming the $Al_2O_3$ layer.

The oxidizing atmosphere is an oxidizing environment having as a mixture component an oxidizing gas containing 20% by volume of oxygen, or steam or $CO_2$.

The heat treatment is conducted at a temperature of at least 900° C., preferably at least 1050° C., and the heating time is at least 1 hour.

When the cast body having a composition of the present Cr—Ni—Al heat-resistant alloy is heat-treated in an oxidizing atmosphere, a Cr-oxide scale consisting mainly of $Cr_2O_3$ is typically deposited and scattered around on the surface of the $Al_2O_3$ layer. Since the Cr-oxide scale easily spalls off as previously stated and separates along with the underlying $Al_2O_3$ layer, it is desired to diminish the formation of Cr-oxide scale to the greatest possible extent.

The inventors have conducted intensive research and consequently found that the surface roughness of the cast body before the $Al_2O_3$ layer is formed thereon relates to the formation of Cr-oxide scale on the $Al_2O_3$ layer surface. We have found it preferable to provide surface roughness of 0.05 to 2.5 (Ra) in order to diminish the formation of Cr-oxide scale on the $Al_2O_3$ layer.

Based on these findings, the cast product of the present invention is to diminish Cr-oxide scales to be scattered around on the $Al_2O_3$ layer, up to less than 20 area % in the surface of the alloy product, in order for $Al_2O_3$ layer to occupy at least 80 area % in the surface of the alloy product, when said surface is observed by SEM/EDX.

Presumably, the relationship between the surface roughness and the formation of a Cr-oxide scale will be such that the surface strain produced by machining exerts influence on the formation of the Cr-oxide scale. It is thought that in the case of great surface roughness, great machining strain occurs in indentations, and the heat given is delivered to the strain line, permitting Cr to readily move to the surface to form the Cr-oxide scale with ease. If the surface roughness is very small, on the other hand, the machining surface becomes active to readily form Cr passivity layer, so that the Cr-oxides will be formed in preference to the $Al_2O_3$ layer when the Cr passivity layer is heated.

<Cr-Based Particles>

Cr-based particles are particles having a higher Cr concentration than the matrix of the alloy. These particles are formed beneath the $Al_2O_3$ layer simultaneously with the formation of this layer during the heat treatment and are present as dispersed between the $Al_2O_3$ layer and the matrix of the cast body.

The Cr particles contain Cr, Ni, Fe, and W and/or Mo, and are preferably over 50% in Cr content. Although not defined, the maximum Cr content may be about 80%. These particles may contain Si, O (oxygen), etc.

When the Cr-based particles are about 50 to about 80% in Cr content, these particles have at 1000° C. a coefficient of thermal expansion of about $12\times10^{-6}$, which is a value intermediate between the corresponding value, about $8\times10^{-6}$, of $Al_2O_3$ and the corresponding value, about $17\times10^{-6}$, of the matrix of the alloy. It is therefore thought that even if the product is repeatedly subjected to a rise in temperature and a fall of temperature, the Cr-based particles serve as a buffer between the $Al_2O_3$ layer and the cast body, giving spalling resistance to the $Al_2O_3$ layer.

The Cr-based particles are circular or elliptical in cross section, and up to about 5 μm in mean particle size. For the Cr particles to perform the function of a barrier between the $Al_2O_3$ layer and the cast body, it is desired that at least two such particles be present in the range of a sectional length of 20 μm at the junction between the $Al_2O_3$ layer and the alloy matrix.

EXAMPLES

Sample tubes (146 mm in outside diameter, 22 mm in wall thickness and 270 mm in length) having various compositions were cast by preparing molten alloys by atmospheric melting in a high-frequency induction melting furnace and centrifugally die-casting the molten alloys. For the evaluation of spalling resistance, test pieces (20 mm in width, 30 mm in length and 5 mm in thickness) were cut off from the test tubes. Table 1 shows the compositions of the test pieces.

First, each of the test pieces was machined over the surface. Table 2 shows the resulting surface roughness (Ra).

Next, the test piece as the cast body was heated in the atmosphere (containing about 21% of oxygen) at a temperature listed in Table 2 for 10 hours, and thereafter treated by furnace cooling.

The test piece treated by the above procedure was checked by measuring the thickness (μm) of the resulting $Al_2O_3$ layer and the surface area ratio (%) of $Al_2O_3$ in the test piece. Table 2 shows the measurements obtained.

The thickness of the $Al_2O_3$ layer was measured under SEM. The samples in Table 2 indicated by "N" (No) are those having no $Al_2O_3$ layer formed, or those wherein the $Al_2O_3$ layer locally had discrete portions having a thickness of less than 0.5 μm (including portions of zero thickness).

The area ratio of $Al_2O_3$ in the surface of the test piece was calculated by measuring the distribution of Al in the test piece surface region of 1.35 mm×1 mm by area analysis using SEM/EDX, and converting the distribution measurement to an area ratio.

As to the Cr-based particles, those wherein such particles were found formed as dispersed beneath the $Al_2O_3$ layer are indicated by "Y" (Yes), and those having none of such particles are indicated by "N" (No).

<Spalling Resistance Test>

This test is to check to see the cyclic oxidation resistance of the cast product.

The test piece was heated in the atmosphere at 1050° C. for 10 hours and then subjected to furnace cooling treatment, and this procedure was repeated five times. The test piece was checked to see for weight before the start of heating and after the five repetitions for the evaluation of the walling resistance in terms of a weight increase or decrease. The test piece was evaluated as satisfactory in spalling resistance when the five repetitions resulted in a weight increase of at least 0.2 $mg/cm^2$, and is indicated by "Y" (Yes). Alternatively, when exhibiting a weight increase of less than 0.2 $mg/cm^2$ or a weight decrease, the test piece was evaluated as inferior in spalling resistance and is indicated by "N" (No).

<Ductility Test>

Tensile test pieces were prepared according to JIS Z2201 from the sample tubes. The test pieces each had a parallel portion of 10 mm in diameter and 50 mm in length.

A ductility test was conducted according to JIS Z2241, Method of Tensile Test for Metal Materials. The test was conducted at room temperature because differences appear more apparently than at a high temperature.

Tables 1 and 2 are given below.

"REM" in Table 1 represents "rare-earth elements." The mark "--" in Table 2 shows that the test piece was not checked for measurement or not tested.

TABLE 1

| Sample | Alloy composition (balance Fe and inevitable impurities) (mass %) | | | | | | | | | | | | |
|---|---|---|---|---|---|---|---|---|---|---|---|---|---|
| No. | C | Si | Mn | Cr | Ni | Al | REM | W | Mo | Ti | Zr | Nb | B |
| 1 | 0.42 | 1.5 | 1.1 | 24.9 | 34.9 | 2.9 | 0.21 | 3.2 | — | — | — | — | — |
| 2 | 0.45 | 1.4 | 1.0 | 24.6 | 34.5 | 3.3 | 0.26 | — | 3.1 | — | — | — | — |
| 3 | 0.44 | 1.4 | 1.2 | 25.5 | 35.0 | 2.7 | 0.24 | 3.0 | — | — | 0.23 | — | — |
| 4 | 0.42 | 1.2 | 1.1 | 25.1 | 34.7 | 2.9 | 0.28 | 2.8 | — | 0.16 | — | — | — |
| 5 | 0.45 | 1.3 | 1.2 | 25.4 | 34.8 | 2.7 | 0.23 | 2.7 | — | — | — | — | 0.05 |
| 6 | 0.06 | 1.4 | 0.9 | 25.1 | 35.0 | 3.8 | 0.33 | 3.2 | — | — | — | — | — |
| 7 | 0.31 | 1.5 | 1.3 | 24.7 | 35.4 | 3.4 | 0.35 | 3.3 | — | — | — | — | — |
| 8 | 0.67 | 1.3 | 1.2 | 24.9 | 34.6 | 3.4 | 0.27 | 3.3 | — | — | — | — | — |
| 9 | 0.42 | 1.3 | 1.2 | 24.7 | 34.9 | 2.1 | 0.29 | 3.4 | — | — | — | — | — |
| 10 | 0.37 | 1.6 | 1.2 | 24.8 | 34.8 | 3.5 | 0.07 | 2.7 | — | — | — | — | — |
| 11 | 0.39 | 1.4 | 1.1 | 24.9 | 34.6 | 3.5 | 0.39 | 3.0 | — | — | — | — | — |
| 12 | 0.38 | 1.5 | 1.1 | 24.8 | 20.0 | 3.1 | 0.34 | 3.2 | — | — | — | — | — |
| 13 | 0.44 | 1.2 | 1.2 | 17.5 | 69.0 | 3.4 | 0.33 | 3.5 | — | — | — | — | — |
| 14 | 0.44 | 1.3 | 1.0 | 25.1 | 33.7 | 3.3 | 0.28 | 1.4 | — | — | — | — | — |
| 15 | 0.41 | 1.4 | 1.1 | 25.2 | 34.8 | 3.5 | 0.27 | 5.6 | — | — | — | — | — |
| 16 | 0.39 | 1.3 | 1.2 | 25.3 | 35.5 | 3.2 | 0.24 | 2.3 | 1.2 | — | — | — | — |
| 17 | 0.40 | 1.5 | 1.2 | 25.2 | 35.0 | 3.1 | 0.22 | 3.0 | — | 0.10 | 0.11 | — | — |
| 21 | 0.40 | 0.4 | 0.1 | 22.9 | 34.7 | 3.6 | 0.01 | 2.9 | — | — | — | — | — |
| 22 | 0.42 | 0.3 | 0.2 | 23.5 | 34.8 | 3.5 | 0.03 | 3.0 | — | — | — | — | — |
| 23 | 0.15 | 0.4 | 0.2 | 23.6 | 34.5 | 3.4 | 0.27 | 6.4 | — | — | — | — | — |
| 24 | 0.12 | 0.4 | 0.2 | 24.0 | 34.2 | 3.4 | 0.27 | 9.7 | — | — | — | — | — |
| 31 | 0.43 | 0.3 | 0.1 | 24.2 | 34.1 | 3.2 | 0.24 | 2.8 | — | 0.15 | — | — | — |
| 32 | 0.40 | 0.5 | 0.2 | 23.7 | 34.5 | 3.4 | 0.06 | 2.9 | — | — | — | — | — |
| 33 | 0.43 | 0.4 | 0.2 | 23.6 | 33.8 | 3.4 | 0.28 | 2.1 | — | — | — | — | — |
| 34 | 0.36 | 0.3 | 0.2 | 24.0 | 34.0 | 3.1 | 0.22 | 2.7 | — | — | — | — | — |
| 35 | 0.41 | 1.5 | 1.1 | 23.9 | 33.4 | 2.9 | 0.19 | — | 2.9 | 0.12 | — | — | — |
| 36 | 0.38 | 1.3 | 0.9 | 23.7 | 33.7 | 3.8 | 0.16 | 2.5 | — | — | 0.18 | — | — |
| 37 | 0.33 | 0.3 | 0.2 | 24.4 | 45.3 | 3.6 | 0.18 | 2.8 | — | 0.08 | — | 0.2 | — |
| 38 | 0.26 | 0.4 | 0.2 | 23.8 | 44.4 | 3.5 | 0.13 | — | 2.1 | — | — | 1.6 | — |
| 101 | 0.43 | 1.4 | 1.0 | 25.0 | 35.1 | 3.2 | — | — | — | — | — | — | — |

TABLE 1-continued

| Sample | Alloy composition (balance Fe and inevitable impurities) (mass %) | | | | | | | | | | | | |
|---|---|---|---|---|---|---|---|---|---|---|---|---|---|
| No. | C | Si | Mn | Cr | Ni | Al | REM | W | Mo | Ti | Zr | Nb | B |
| 102 | 0.40 | 1.4 | 0.9 | 24.7 | 34.8 | 2.8 | 0.22 | — | — | — | — | — | — |
| 103 | 0.37 | 1.1 | 1.3 | 24.7 | 35.1 | 3.3 | 0.11 | 0.3 | — | — | — | — | — |
| 104 | 0.44 | 1.5 | 1.2 | 25.4 | 34.6 | 3.2 | 0.24 | 6.6 | — | — | — | — | — |
| 105 | 0.39 | 1.3 | 0.9 | 25.0 | 35.4 | 1.6 | 0.24 | 2.8 | — | — | — | — | — |
| 106 | 0.41 | 1.2 | 1.2 | 25.5 | 34.7 | 4.2 | 0.28 | 3.4 | — | — | — | — | — |
| 107 | 0.37 | 1.3 | 1.0 | 24.4 | 33.9 | 5.6 | 0.30 | 3.1 | — | — | — | — | — |
| 108 | 0.78 | 1.8 | 0.8 | 25.5 | 35.5 | 2.5 | 0.18 | 2.6 | — | — | — | — | — |
| 109 | 0.40 | 1.3 | 0.9 | 25.4 | 12.0 | 3.0 | 0.29 | 2.9 | — | — | — | — | — |
| 110 | 0.40 | 1.5 | 1.2 | 24.8 | 34.6 | 3.3 | 0.04 | 2.9 | — | — | — | — | — |
| 111 | 0.37 | 1.4 | 1.1 | 25.3 | 34.6 | 3.3 | 0.45 | 3.1 | — | — | — | — | — |
| 121 | 0.27 | 0.5 | 0.2 | 23.8 | 33.6 | 3.2 | 0.19 | 11.7 | — | — | — | — | — |
| 131 | 0.38 | 0.5 | 0.2 | 23.9 | 33.9 | 3.3 | 0.23 | 2.7 | — | 0.09 | — | — | — |
| 132 | 0.37 | 0.4 | 0.1 | 23.7 | 32.7 | 3.3 | 0.18 | 2.7 | — | — | — | — | — |
| 133 | 0.40 | 0.4 | 0.2 | 23.8 | 32.5 | 3.1 | 0.17 | 2.4 | — | — | — | — | — |
| 134 | 0.34 | 0.7 | 0.2 | 25.0 | 45.4 | 2.8 | 0.10 | — | 1.5 | — | — | 2.0 | — |

TABLE 2

| Sample No. | Surface roughness (Ra) | Heating temp. (° C.) | $Al_2O_3$ Layer-thickness (μm) | $Al_2O_3$ Area ratio in TP surface (%) | Cr-based particles | Spalling resistance | Tensile ductility (%) |
|---|---|---|---|---|---|---|---|
| 1 | 0.11 | 1000 | 1.2 | 90 | Y | Y | 10.3 |
| 2 | 0.11 | 1000 | 1.2 | 93 | Y | Y | 9.6 |
| 3 | 0.12 | 1000 | 1.0 | 88 | Y | Y | 10.8 |
| 4 | 0.11 | 1000 | 1.0 | 90 | Y | Y | 10.5 |
| 5 | 0.14 | 1000 | 0.9 | 88 | Y | Y | 12.2 |
| 6 | 0.12 | 1000 | 1.1 | 97 | Y | Y | 47.6 |
| 7 | 0.10 | 1000 | 1.1 | 94 | Y | Y | 13.8 |
| 8 | 0.13 | 1000 | 1.0 | 95 | Y | Y | 8.0 |
| 9 | 0.12 | 1000 | 0.7 | 85 | Y | Y | 13.0 |
| 10 | 0.11 | 1000 | 0.9 | 91 | Y | Y | 11.1 |
| 11 | 0.12 | 1000 | 1.2 | 93 | Y | Y | 10.7 |
| 12 | 0.12 | 1000 | 1.2 | 86 | Y | Y | 13.5 |
| 13 | 0.13 | 1000 | 0.9 | 96 | Y | Y | 18.2 |
| 14 | 0.12 | 1000 | 1.2 | 91 | Y | Y | 13.3 |
| 15 | 0.14 | 1000 | 0.9 | 89 | Y | Y | 7.8 |
| 16 | 0.12 | 1000 | 1.1 | 94 | Y | Y | 9.8 |
| 17 | 0.15 | 1000 | 1.0 | 90 | Y | Y | 9.5 |
| 21 | 0.22 | 1050 | 1.6 | 86 | Y | Y | 12.6 |
| 22 | 0.20 | 1050 | 1.5 | 90 | Y | Y | 12.4 |
| 23 | 0.22 | 1050 | 1.0 | 94 | Y | Y | 15.8 |
| 24 | 0.24 | 1050 | 0.9 | 90 | Y | Y | 18.0 |
| 31 | 1.0 | 1050 | 1.7 | 90 | Y | Y | 12.3 |
| 32 | 0.9 | 1050 | 1.8 | 91 | Y | Y | 16.3 |
| 33 | 1.3 | 1050 | 1.7 | 93 | Y | Y | 10.4 |
| 34 | 2.4 | 1050 | 1.9 | 87 | Y | Y | 11.7 |
| 35 | 0.15 | 1050 | 1.7 | 94 | Y | Y | 12.5 |
| 36 | 0.18 | 1050 | 1.8 | 93 | Y | Y | 8.8 |
| 37 | 0.14 | 1050 | 1.5 | 92 | Y | Y | 18.8 |
| 38 | 0.13 | 1050 | 1.6 | 90 | Y | Y | 25.4 |
| 101 | 0.13 | 1000 | N | <80 | N | — | 8.8 |
| 102 | 0.13 | 1000 | N | <80 | N | — | 10.2 |
| 103 | 0.11 | 1000 | 1.1 | <80 | N | — | 9.4 |
| 104 | 0.13 | 1000 | N | <80 | N | — | 6.3 |
| 105 | 0.12 | 1000 | N | <80 | N | — | 12.5 |
| 106 | 0.13 | 1000 | 1.6 | 95 | Y | Y | 2.8 |
| 107 | 0.11 | 1000 | 1.7 | 98 | Y | Y | 0.4 |
| 108 | 0.11 | 1000 | N | — | N | — | 3.2 |
| 109 | 0.12 | 1000 | N | — | N | — | 11.4 |
| 110 | 0.11 | 1000 | N | — | N | — | 13.0 |
| 111 | 0.13 | 1000 | 0.8 | 96 | Y | Y | 4.0 |
| 121 | 2.1 | 1050 | N | <80 | N | — | — |
| 131 | 0.03 | 1050 | N | <80 | N | — | — |
| 132 | 2.9 | 1050 | N | <80 | N | — | — |
| 133 | 7.0 | 1050 | N | <80 | N | — | — |
| 134 | 0.12 | 1050 | N | <80 | N | N | — |

<Test Results>

With reference to Tables 1 and 2, Samples No. 1 to No. 17, No. 21 to No. 24 and No. 31 to No. 38 are examples of the present invention.

The examples of the invention are satisfactory in spalling resistance and found to be excellent in cyclic oxidation resistance. These examples also are highly ductile in the tensile ductility test.

FIG. 1 is an SEM photograph of a section of No. 7 test piece in the vicinity of its surface, showing Cr-based particles formed at the interface between the $Al_2O_3$ layer and the cast body. A resin is seen in the photograph because the test piece was photographed as embedded in the resin.

Figure 2:
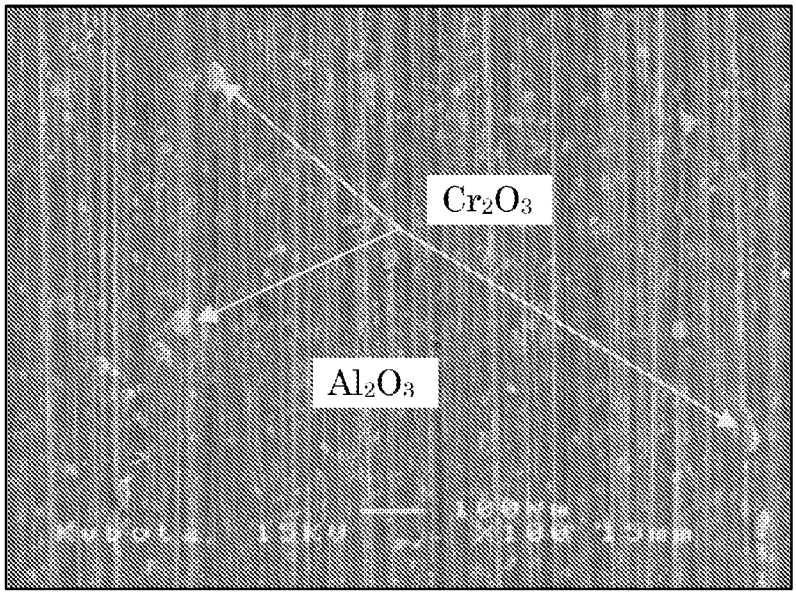
FIG. 2 is an SEM photograph of the surface of Invention Example Sample No. 10.

FIG. 2 is an SEM photograph of the surface of the No. 10 test piece, showing $Cr_2O_3$ formed although in a small quantity.

Figure 3:
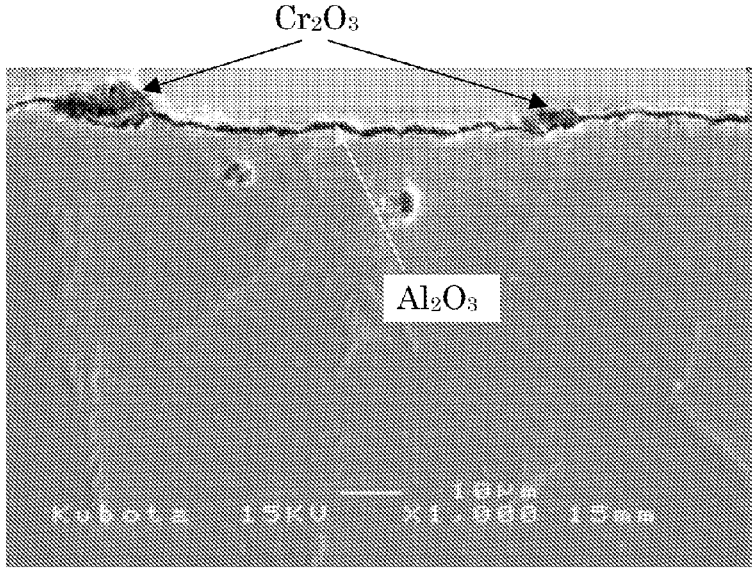
FIG. 3 is an SEM photograph of a section of Invention Example Sample No. 14 in the vicinity of the surface thereof.

FIG. 3 is an SEM photograph of a section of No. 14 test piece in the vicinity of its surface, showing an $Al_2O_3$ layer continuously formed in the form of a layer and having a minimum thickness of at least 0.5 μm, and also a cross section of $Cr_2O_3$ particles deposited on the surface of the $Al_2O_3$ layer.

Samples No. 101 to No. 111, No. 121 and No. 131 to No. 134 are Comparative Examples.

Figure 4:
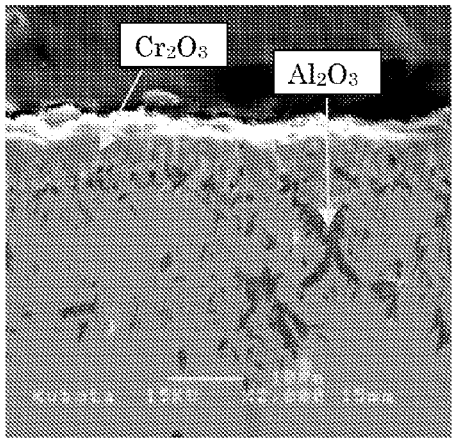
FIG. 4 is an SEM photograph of a section of Comparative Example Sample No. 102 in the vicinity of the surface thereof.

No. 101 is an example containing none of rare-earth elements, W and Mo. No. 102 is an example containing neither W nor Mo and failing to have a continuous $Al_2O_3$ layer having a minimum thickness of at least 0.5 μm. FIG. 4 is an SEM photograph of a section of No. 102 test piece in the vicinity of its surface.

Sample No. 103 is an example having a W content less than is specified by the present invention. Although a continuous $Al_2O_3$ layer of at least 0.5 μm was formed, Cr-based particles were not formed as dispersed beneath the $Al_2O_3$ layer, failing to afford sufficient spalling resistance, thus showing an inferior cyclic oxidation resistance.

Sample No. 104 is 6.6% in W content, failing to have a continuous $Al_2O_3$ layer of at least 0.5 μm. This indicates that the W content is excessive in view of the heating temperature of 1000° C. for forming the $Al_2O_3$ layer, with the result that the movement of Al is hampered to inhibit the formation of $Al_2O_3$ layer.

Incidentally, Invention Examples No. 23 and No. 24 contain 6.4% and 9.7% of W, respectively, but the contemplated $Al_2O_3$ layer was formed in these samples. This substantiates that although a considerable amount of W formed a solid solution in the matrix, Al is movable if the heating temperature is 1050° C.

On the other hand, if the W content is as high as 11.7% as in sample No., 121, no $Al_2O_3$ layer was formed although the heating temperature was 1050° C.

Figure 5:
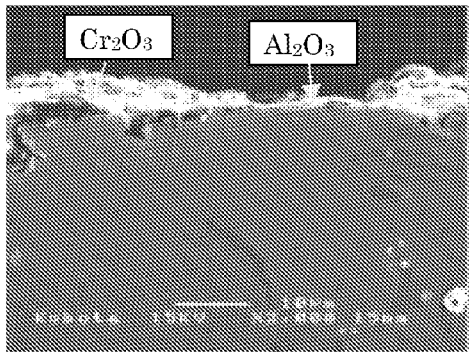
FIG. 5 is an SEM photograph of a section of Comparative Example Sample No. 105 in the vicinity of the surface thereof.

No. 105 is an example having an Al content less than is specified by the present invention. A continuous $Al_2O_3$ layer of at least 0.5 μm in thickness was not formed. FIG. 5 is an SEM photograph of No. 105.

Samples No. 106 and 107 are examples having an Al content greater than is specified by the present invention, and Sample No. 111 is an example having a rare-earth element content greater than is specified by the invention. Although a continuous $Al_2O_3$ layer of at least 0.5 μm was formed, with satisfactory spalling resistance afforded, it is seen that the samples were inferior in tensile ductility.

Sample No. 108 is an example having a C content greater than is specified by the invention. Sample No. 109 is an example having an Ni content less than is specified by the invention. These samples failed to provide a continuous $Al_2O_3$ layer having a thickness of at least 0.5 μm.

Sample No. 110 is 0.04% in rare-earth element content, failing to provide a continuous $Al_2O_3$ layer having a thickness of at least 0.5 μm. This indicates that the heating temperature of 1000° C. is insufficient for the rare-earth element to form an $Al_2O_3$ layer.

Invention Examples No. 21 and No. 22 are only 0.01% and 0.03%, respectively, in rare-earth element content, whereas a specified $Al_2O_3$ layer was formed on each alloy as specified. This shows that the heating temperature of 1050° C. is effective for forming the $Al_2O_3$ layer despite such a small content of rare-earth elements.

Comparative Example No. 131 is an example which is too small in surface roughness, while Comparative Examples No. 132 and No. 133 are examples of excessively great surface roughness. These surface roughness values fail to provide any continuous $Al_2O_3$ layer having a thickness of at least 0.5 μm. With these examples, the $Al_2O_3$ observed in the surface of the test piece was also smaller than 80% in area ratio.

Comparative Example No. 134 contains an excessive amount of Nb and indicates that the continuous $Al_2O_3$ layer having a thickness of at least 0.5 μm was not formed.

As will be apparent from Invention Examples given above, the cast product of the present invention has high ductility, while the $Al_2O_3$ layer formed in its surface is outstanding in spalling resistance and is not likely to spalling off even when subjected to repeated heating-cooling cycles. The $Al_2O_3$ layer is dense and therefore serves to provide an improved cyclic oxidation resistance in use at high temperature atmosphere, thus effectively preventing oxygen, carbon, nitrogen, etc. from penetrating into the product from the outside atmosphere and giving cast product sustained high cyclic oxidation resistance, carburization resistance, nitriding resistance, corrosion resistance, etc. at high temperatures over a prolonged period of time.

Industrial Applicability

The cast product of the invention is outstanding in cyclic oxidation resistance, ductility and toughness in use at high temperature environments. Examples of such products can be reactor tubes for producing ethylene, glass rolls, hearth rolls, conductor rolls, heat exchange tubes for use in high ambient temperatures, metal dusting tubes for GTL (Gas to Liquids), corrosion-resistant tubes to be used in an atmosphere of high sulfur content at high temperatures, and radiant tubes for carburizing furnaces.

The invention claimed is:

1. A cast product for use in high temperature atmosphere, said cast product comprising:

a cast body of a heat-resistant alloy consisting essentially of, in mass percent, 0.05 to 0.7% of C, more than 0% and no more than 2.5% of Si, more than 0% and no more than 3.0% of Mn, 15 to 50% of Cr, 20 to 70% of Ni, 2 to 4% of Al, 0.005 to 0.4% of rare-earth elements, and at least one member selected from the group consisting of 0.5 to 10% of W and 0.1 to 5% of Mo, the balance being Fe and inevitable impurities; and a barrier layer formed on a surface of the cast body to be brought into contact with said high temperature atmosphere;

wherein said barrier layer comprises an $Al_2O_3$ layer having a thickness of 0.5 μm or more;

wherein at least 80 area % of an outermost surface of the cast body is $Al_2O_3$;

wherein said cast product has Cr-based particles dispersed at an interface between the $Al_2O_3$ layer and the cast body at a higher Cr concentration than a Cr concentration of a matrix of the alloy; and wherein the surface of the cast body before forming $Al_2O_3$ layer is of a roughness (Ra) of 0.05 to 2.5.

2. The heat-resistant cast product according to claim 1, wherein said cast body is allowed that Cr-oxide scales consisting essentially of $Cr_2O_3$ are deposited on and scattered around the $Al_2O_3$ layer up to less than 20 area % of the outermost surface of the cast body.

3. The heat-resistant cast product according to claim 2, wherein said heat-resistant alloy contains at least one element selected from the group consisting of 0.01 to 0.6% of Ti, 0.01 to 0.6% of Zr and 0.1 to 1.8% of Nb.

4. The heat-resistant cast product according to claim 2, wherein said heat-resistant alloy contains more than 0% and no more than 0.1% of B.

5. The heat-resistant cast product according to claim 2, wherein said Cr-based particles contain Cr, Ni, Fe, and at least one member selected from the group consisting of W and Mo, the Cr-based particles having a Cr content of more than 50%.

6. The heat-resistant cast product according to claim 2, wherein the heat-resistant alloy contains 0.06 to 0.4% of the rare-earth elements and 0.5 to 6% of W.

7. The heat-resistant cast product according to claim 1 wherein said heat-resistant alloy contains at least one element selected from the group consisting of 0.01 to 0.6% of Ti, 0.01 to 0.6% of Zr and 0.1 to 1.8% of Nb.

8. The heat-resistant cast product according to claim 7, wherein said heat-resistant alloy contains more than 0% to up to and no more than 0.1% of B.

9. The heat-resistant cast product according to claim 7, wherein said Cr-based particles contain Cr, Ni, Fe, and at least one member selected from the group consisting of W and Mo, the Cr-based particles having a Cr content of more than 50%.

10. The heat-resistant cast product according to claim 7, wherein the heat-resistant alloy contains 0.06 to 0.4% of the rare-earth elements and 0.5 to 6% of W.

11. The heat-resistant cast product according to claim 1, wherein said heat-resistant alloy contains more than 0% and no more than 0.1% of B.

12. The heat-resistant cast product according to claim 11, wherein said Cr-based particles contain Cr, Ni, Fe, and at least one member selected from the group consisting of W and Mo, the Cr-based particles having a Cr content of more than 50%.

13. The heat-resistant cast product according to claim 11, wherein the heat-resistant alloy contains 0.06 to 0.4% of the rare-earth elements and 0.5 to 6% of W.

14. The heat-resistant cast product according to claim 1, wherein said Cr-based particles contain Cr, Ni, Fe, and at least one member selected from the group consisting of W and Mo, the Cr-based particles having a Cr content of more than 50%.

15. The heat-resistant cast product according to claim 1, wherein the heat-resistant alloy contains 0.06 to 0.4% of the rare-earth elements and 0.5 to 6% of W.

* * * * *